US007416139B2

(12) United States Patent
Kah, Jr.

(10) Patent No.: US 7,416,139 B2
(45) Date of Patent: Aug. 26, 2008

(54) SPEED LIMITING TURBINE FOR ROTARY DRIVEN SPRINKLER

(76) Inventor: Carl L Kah, Jr., 11517 Turtle Beach Rd., Lost Tree, North Palm Beach, FL (US) 33408

( * ) Notice: Subject to any disclaimer, the term of this patent is extended or adjusted under 35 U.S.C. 154(b) by 0 days.

(21) Appl. No.: 10/141,261

(22) Filed: May 7, 2002

(65) Prior Publication Data

US 2002/0162902 A1 Nov. 7, 2002

Related U.S. Application Data

(60) Provisional application No. 60/289,227, filed on May 7, 2001.

(51) Int. Cl.
*B05B 3/04* (2006.01)
*B05B 3/06* (2006.01)

(52) U.S. Cl. ..... 239/240; 239/112; 239/237; 239/252; 239/570

(58) Field of Classification Search ..... 239/104, 239/106, 112, 237, 240, 241, 242, 263, 570, 239/571, 252
See application file for complete search history.

(56) References Cited

U.S. PATENT DOCUMENTS

| | | | | |
|---|---|---|---|---|
| 3,107,056 | A | 10/1963 | Hunter | |
| 4,568,024 | A | 2/1986 | Hunter | |
| 4,624,412 | A | 11/1986 | Hunter | |
| 4,718,605 | A | 1/1988 | Hunter | |
| 4,763,837 | A * | 8/1988 | Livneh | 239/111 |
| 4,796,809 | A | 1/1989 | Hunter | |
| 4,815,662 | A | 3/1989 | Hunter | |
| 4,867,379 | A | 9/1989 | Hunter | |
| 4,948,052 | A | 8/1990 | Hunter | |
| 5,288,022 | A * | 2/1994 | Sesser | 239/205 |
| 5,372,307 | A | 12/1994 | Sesser | |
| 5,375,768 | A * | 12/1994 | Clark | 239/210 |
| 5,377,914 | A | 1/1995 | Christen | |
| 5,762,270 | A | 6/1998 | Kearby et al. | |
| 5,823,440 | A * | 10/1998 | Clark | 239/206 |
| 5,971,297 | A | 10/1999 | Sesser | |
| 6,199,584 | B1 | 3/2001 | Brown et al. | |
| 6,732,950 | B2 | 5/2004 | Ingham, Jr. et al. | 239/205 |
| 2002/0162901 | A1 * | 11/2002 | Hunter et al. | 239/240 |

* cited by examiner

*Primary Examiner*—Davis D Hwu
(74) *Attorney, Agent, or Firm*—Ostrolenk, Faber, Gerb & Soffen, LLP

(57) ABSTRACT

A speed limiting mechanisms for turbine-driven fluid distribution apparatus usable with compressible fluid such as compressed air and incompressible fluid such as water. In one form, a flow restrictor is located in the turbine discharge flow path, with the turbine discharge port area selected in relation to the turbine inlet port area according to the desired turbine speed with compressed air. In another form, the incoming fluid flows downstream along the surface of the turbine stator, and is then diverted to enter the rotor chamber in the proper direction. A bleed area on the stator which permits a portion of a compressible fluid which has expanded as it flows along the stator surface to flow to bypass the turbine rotor.

43 Claims, 4 Drawing Sheets

SPEED LIMITING TURBINE FOR ROTARY DRIVEN SPRINKLER

CROSS REFERENCE TO RELATED APPLICATION

This application is based on and claims benefit of U.S. Provisional Patent Application No. 60/289,227 filed May 7, 2001 entitled SPEED LIMITING TURBINE FOR ROTARY DRIVEN SPRINKLER, the disclosure of which is hereby incorporated by reference and to which a claim of priority is hereby made.

TECHNICAL FIELD OF INVENTION

The invention relates to sprinkler where a water driven turbine causes the sprinkler nozzle to rotate to provide coverage over a desired area.

BACKGROUND OF THE INVENTION

Sprinkler systems in the northern climates must be drained or blown-out with air to clear the water to prevent freezing damage. In many cases the simplest installation provides only for allowing the irrigation system pipes and sprinklers to be cleared of water by blowing out the system using compressed air. This can be very damaging to the sprinklers which have water turbines which are normally water powered and rotate at a much slower speed with the water which is a relatively heavy incompressible fluid and does not generate the high turbine stator velocities produced when air, an expandable relatively light fluid, is expanded across the turbine stator onto the turbine blades.

The high turbine shaft velocities can heat the shaft and cause it to seize to the plastic housing material. This prevents the turbine from turning and renders it unusable in the future unless care is taken to limit the system air, blow-out time and pressures. This has proved to be one of the major causes for premature failure of gear driven sprinkler in colder climates, where sprinklers are used for only part of the year, and should last much longer than in warmer climates where they are run year round.

Devices are known for controlling the rotational speed of turbine-driven sprinklers. One such device, shown in Clark U.S. Pat. No. 5,375,768, is designed to maintain constant turbine speed despite variations of inlet water pressure. The patented sprinkler relies on a throttling device to direct part of the water to the turbine rotor, and a pressure responsive valve to divert some of the water around the turbine. This design, however, can not effectively limit rotational speed when the turbine is driven by a compressible fluid such as air, and still allow the turbine to run at a sufficiently high speed when it is driven by an incompressible fluid such as water because of the rapid expansion of the compressed air as it enters the turbine chamber.

Other turbine speed limiting mechanisms are known, but to applicant's knowledge, none of these are suitable for turbines which must run on both compressible and incompressible fluids.

SUMMARY OF THE INVENTION

It is accordingly the primary object of this invention to provide a turbine-driven sprinkler which incorporates a speed limiting mechanism which protects the turbine from damage when compressed air is used to blow out the system in preparation for winter, but still permits satisfactory operation when the turbine is water-driven.

A related object of the invention is to provide a turbine-driven sprinkler having a speed limiting mechanism for air (compressible flow) as described which is reliable and can be manufactured inexpensively.

The above objects are achieved according to one aspect of the invention by choking the turbine flow discharge area to be relatively the same as or slightly larger than the inlet stator area. According to another aspect of the invention, the inlet stator flow area can be separated from the turbine blades by a flow bleed area to bleed off a significant portion of the expanding flow before a portion of the gases are deflected to strike the turbine blades to produce the turbine rotation. Water, being incompressible, does not experience the continued expansion after flow through the stator inlet flow area and does not flow out the intermediate bleed but continues in its line of flow to be directed onto the turbine blades to run the turbine in a normal manner. In the case of air (compressible flow) the portion remaining after the intermediate bleed can be limited to just enough to turn the turbine at its normal speed when water-driven.

Other features and advantages of the present invention will become apparent from the following description of the invention which refers to the accompanying drawings.

DETAILED DESCRIPTION OF EMBODIMENTS OF THE INVENTION

Figure 1:
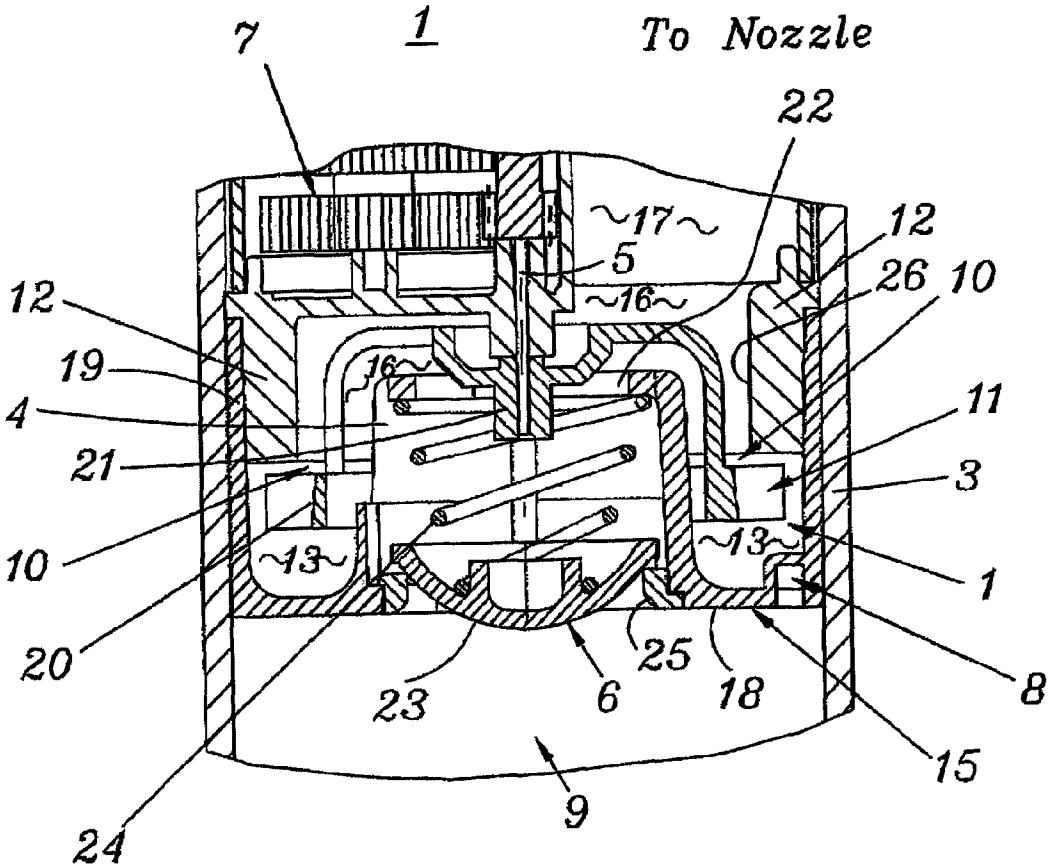
FIG. 1 is a cross-section of an elevation view of the drive turbine area of a turbine-driven sprinkler according to a first embodiment of the invention.

FIG. 1 shows in cross-section, the turbine assembly, generally denoted at 1, of a water turbine driven sprinkler such as described in detail in my U.S. Pat. No. Re 35,037, the disclosure of which is incorporated herein by reference as if fully set forth. The turbine assembly 1 is mounted in a housing 3, and, by way of an output shaft 5, drives a gear box 7 which rotates or oscillates a sprinkler head (not shown). As will be understood, water (or during winterization, compressed air) entering turbine assembly 1 from below at 9 drives the turbine, and thereafter flows through an outlet passage 17 to the sprinkler head.

The turbine itself is comprised of a rotor 11 located in a rotor chamber 13 formed by a stator cover assembly 15 positioned on the upstream side of the turbine, and a lower cover 12 for gearbox 7. Stator cover assembly 15 is in the form of an inverted cup with a central portion 4 that houses a flow bypass valve sub-assembly 6 described below. Extending radially from the bottom of central portion 4 is a shoulder 18 which terminates in an upwardly extending skirt portion 19.

Circumferentially spaced around the bottom shoulder 18 of stator cover 15 are a plurality of tangentially directed turbine stator flow inlet ports 8 through which water flows into rotor chamber 13. As the incoming fluid passes through openings 8, it experiences acceleration due to the pressure difference between the inlet area 9 to the turbine housing and the pressure in cavity 13 as maintained by the turbine by-pass assembly valve 6, and then tangentially strikes the turbine rotor 11, causing it to turn, and to drive gearbox box 7 through shaft 5. The fluid then exits rotor chamber 13 through an annular discharge port 10 between the turbine rotor 11 and a circumferential blade support ring 20 and the lower gear box cover ring 12. Discharge port 10 communicates with an outer chamber 16 above stator cover 15, which, in turn, communicates with discharge passage 17.

The hub portion 21 of rotor 11 passes through a circular opening 22 at the top of stator 15. Circular opening 22 also provides communication between the interior of stator cup 4 and outer chamber 16.

Located within stator cup 4 is turbine by-pass valve assembly 6. This is comprised of a valve plug 23 which is biased into a closed position against the upper surface of a valve seat member 25 by a spring 24. As will be understood, when the inlet fluid pressure is sufficient to overcome the force of spring 24, a portion of incoming fluid is diverted by valve 6 to discharge passage 17 through the interior of stator cup 4, circular opening 22, and outer chamber 16. The purpose of this valve is to maintain the desired differential pressure across the turbine inlet ports 8, to drive the turbine at the desired speed and power with water.

Achieving proper performance for the sprinkler both when the turbine is water-driven and also preventing over speeding when it is air-driven depends on the selection of the area of turbine circumferential discharge port 10 and the flow pressure drop established by flow control valve 6. To assure overspeed protection for turbine rotor 11 during blow out, the area of discharge port 10 must be restricted, but the area must be large enough for the turbine to provide the desired torque to gearbox 7 for the pressure drop established by spring 24 of the flow bypass valve assembly 6 when operating in water.

In any event, the discharge port area must be, at a minimum, slightly larger than the collective area of the multiple turbine stator inlet ports 8. However, since the water is incompressible, and does not expand, increasing the area beyond a certain point does not improve turbine torque performance and just allows for greater expansion and flow of air when the turbine is air-driven, and allows it to overspeed.

For a turbine driven by an incompressible fluid such as water, and especially in the simple, single-stage turbines used to drive sprinklers the turbine flow exist velocity remains relatively high, the difference in velocity resulting from energy absorbed by the turbine wheel and flow friction inefficiencies. Thus, in accordance with the continuity equation for flow that requires that the product of inlet flow area and inlet flow velocity must equal the product of the exit flow area and the exit flow velocity, large increases in exit flow area are not required for proper operation and power for water.

Taking all these factors into consideration, good results, in terms of enhancement of the life of turbine-driven sprinklers, and elimination of destructive turbine over-speeding during blowout with air, can be achieved by limiting the turbine discharge area to no more than twice the collective turbine stator inlet area, and preferably about 1.5 times the collective turbine stator inlet area. This can be made smaller (but no less than equal to the collective turbine stator inlet area) to limit even further the turbine speed when driven by air.

As shown in FIG. 1, the area of discharge port 10 is determined by the spacing between inside wall 26 of ring 12 and the outer wall of turbine ring 20. Thus, the area of discharge port 10 is determined by the internal diameter of ring 12 and the outside diameter of ring 20.

In most of the sprinklers being manufactured today, the turbine discharge area is not restricted and is simple to open to allow turbine flow to move through the sprinkler housing 2 and area 16 and 17 up to the sprinkler's discharge nozzle (not shown).

FIGS. 2-5 illustrate a second embodiment of the invention, in which a different mechanism is employed for limiting turbine over-speed when it is run on compressed air during winterization.

Figure 2:
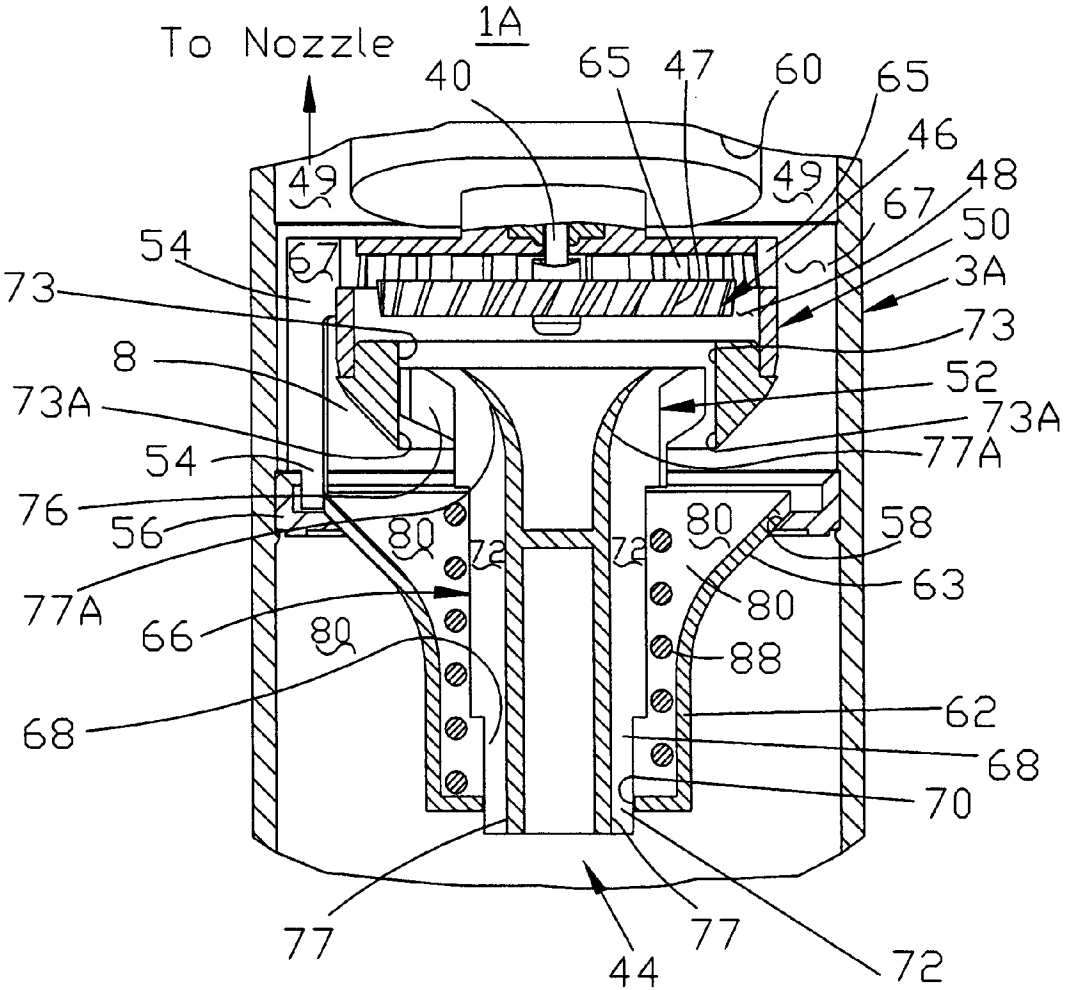
FIG. 2 is a cross-section of an elevation view of the drive turbine area of a turbine-driven sprinkler according to a second embodiment of the invention which shows the spring loaded flow bypass valve in the fully closed position.
Figure 3:
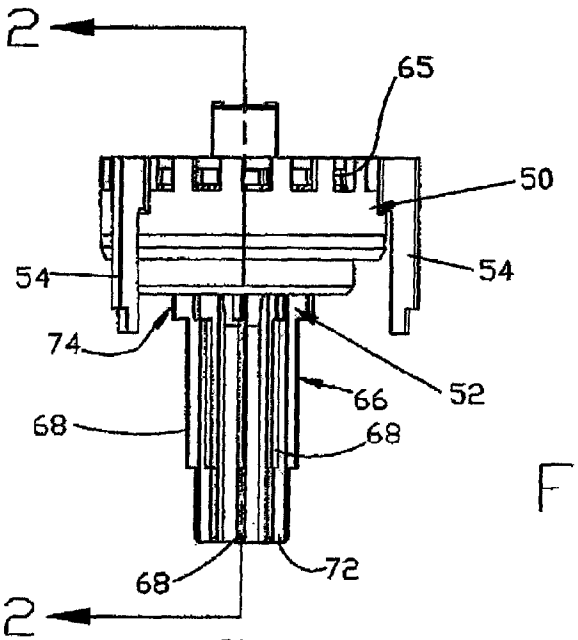
FIG. 3 is a side elevation of the rotor housing and the flow deflector according to the second embodiment.

Referring to FIGS. 2 and 3, modified turbine assembly 1A is mounted in a housing 3A, and, by way of an output shaft 40, drives a gearbox 60 which rotates or oscillates a sprinkler head (not shown). Water or compressed air entering turbine assembly 1A from below at 44 drives the turbine, and thereafter flows through outlet passages 67 and 49 to the sprinkler nozzle.

The turbine is comprised of a rotor 46 located in a rotor chamber 48 formed by an internal housing 50 having spaced legs 54 around its outside circumference. A flow directing swirl member 52 includes a lower (upstream) body portion 66 having a plurality of circumferentially spaced longitudinal ribs 68. A by-pass flow valve 62 described below having a central opening 70 is positioned in radially spaced relationship around the upstream body portion 66. As illustrated in FIG. 2, opening 70 cooperates with ribs 68 and surface 77 of lower body portion 66 of swirl member 52 to form a series of longitudinal passages 72 running from inlet 44 up along swirl member 66. At its upper end 74, surface 77 is curved outwardly as shown at 77A.

Figure 4:
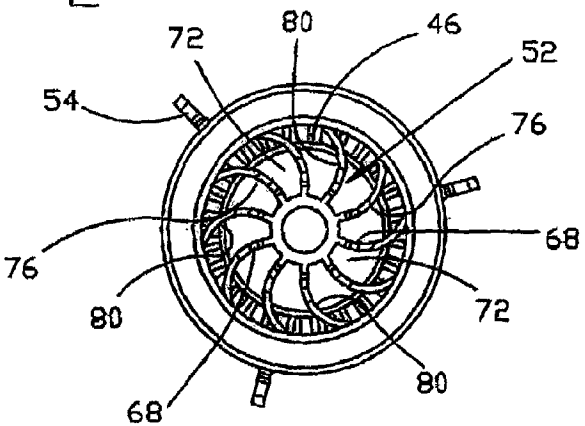
FIG. 4 shows a top view of the flow deflector stator.

At the upper (downstream) end 74 of swirl member 66, the radial inner edges of ribs 68 are also curved outwardly and circumferentially to form swirl deflector surfaces 80. These cooperate with a series of circumferentially spaced swirl ribs 76 that spiral outwardly as shown in FIG. 4 to cause the axially flowing fluid in flow passages 72 to be deflected outwardly and circumferentially so that it passes through a swirl ring opening 73 where it strikes the vanes 47 of turbine rotor 46. After imparting energy to rotate the turbine, the fluid flows out through a series of radial exit ports 65 into a flow area 67 between interior housing 50 and exterior housing 3A, and from there, through outlet passage 49 to the sprinkler head (not shown).

When the turbine is water-driven, the inertia of the incompressible water carries it straight up ribbed passages 72, past deflector surfaces 77A and swirl ribs 76, and though swirl ring opening 73 to strike turbine rotor blades 47 which are rotating in rotor chamber 48. However, when compressed air is used to blow out the irrigation system during winterization, the air continues to expand after traveling through passage 72 as it moves upwardly, and a significant amount escapes through open bleed area 80 into a bypass flow area 67, and from there, into discharge area 49 around gear box 60 to the sprinkler nozzle at the exit top end of the sprinklers.

Only the air that continues straight up along the ribbed passages 72 passes through the swirl ring opening 73 to drive turbine rotor 46, and thus the energy transferred to the rotor is much less than if the entire incoming air flow had been allowed to enter rotor chamber 48. The shape and opening size of the swirl ring opening 73A can be used to determine how much air flow is allowed to reach the turbine without limiting the water flow.

Bypass flow valve 62 includes an outwardly tapered upper portion 63 that serves a valve closure member with ring 56. A beveled radially inner surface 58 of ring 56 forms a valve seat that cooperates with valve closure member 63. A spring 88 biases valve closure member 63 upward against valve seat 58 so that valve 62 is normally closed, as illustrated in FIG. 2.

Figure 5:
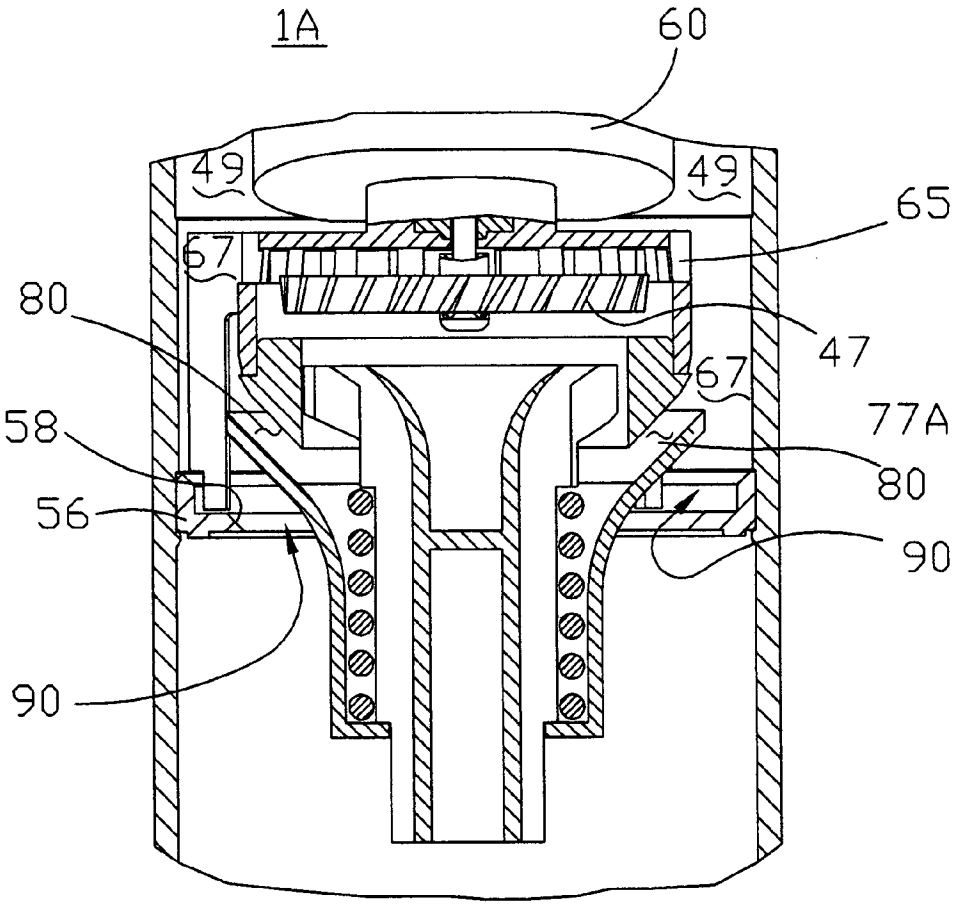
FIG. 5 shows a cross-section of an elevation view of the turbine area of FIG. 2 but with the flow bypass valve in the fully open position.

In FIG. 5, by-pass flow valve 62 is shown in its open position. This allows flow in excess of what is needed to drive the turbine to be bypassed through valve opening 90 around the turbine and up through discharge passage 49 around the gear box 60. Once the required differential pressure is established across opening 72 to provide the desired turbine speed and power by the strength of spring 88 acting on valve member 62, the balance of the flow is bypassed by allowing valve 62 to open as previously explained.

The turbine rotor speed is a result of momentum interchange between the flowing fluid and the turbine rotor blades and depends on turbine design for simplicity and efficiency. Many different designs may be employed to achieve the required power to rotate the sprinkler head, as will be appreciated by those skilled in the art.

To allow simpler construction, inner housing 50 may be eliminated. However, inner housing 50 provides protection from high bypass flow velocities and dirt for turbine rotor 46. Discharge ports 65 also provide an additional throttling mechanism to limit the turbine speed when it is being blown out.

Although the present invention has been described in relation to particular embodiments thereof, many other variations and modifications and other uses will become apparent to those skilled in the art. It is intended, therefore, that the present invention be limited not by the specific disclosure herein, but only by the appended claims.

What is claimed is:

1. A sprinkler comprising:

an inlet connectable to a source of operating fluid, wherein the operating fluid is water for normal operation, or compressed air to blow water out of the sprinkler to prevent freezing during cold weather;

a turbine having a rotor which is driven by the incoming operating fluid and a flow directing stator; and a speed control mechanism located in the fluid flow path which is responsive to behavior exhibited by the operating fluid when that fluid includes compressed air, but is not exhibited by the operating fluid when that fluid does not include compressed air to limit the rotational speed of the turbine when the operating fluid includes compressed air, but which has substantially no limiting effect on rotational speed of the turbine when the operating does not include compressed air, irrespective of the pressure of the operating fluid, within an expected operating pressure range for both water and air, the speed control mechanism including a flow restrictor located in a turbine discharge flow path for the turbine; wherein the turbine rotor is located in a chamber;

the flow restrictor includes a discharge port for the rotor chamber; and the area of the discharge port is selected such that the flow of the driving fluid through the rotor chamber is limited when the fluid is compressed air, but is substantially unaffected when the fluid is water; and wherein driving fluid for the rotor enters the rotor chamber through a plurality of inlet ports; and the area of the rotor chamber discharge port exceeds the total area of the inlet ports.

2. A sprinkler as defined in claim 1, wherein the ratio of the area of the rotor chamber discharge port to the total area of the inlet ports is in the range of approximately 1.0 and 2.0.

3. A sprinkler as defined in claim 1, wherein the area of the rotor chamber discharge port is approximately 1.5 times the total area of the inlet ports.

4. A sprinkler as defined in claim 1, further including a bypass valve that is responsive to the pressure of incoming compressed air to divert a portion thereof around the turbine.

5. A sprinkler as defined in claim 4, wherein the bypass valve diverts the portion of the incoming compressed air through a central opening in the turbine stator.

6. A sprinkler as defined in claim 1, wherein:

the turbine rotor is located in a chamber;

the flow restrictor comprises a discharge port for the rotor chamber; and the area of the discharge port is selected such that the flow of the driving fluid through the rotor chamber is limited when the fluid is compressed air due to its expansion to a larger volume and lower density, but is substantially unaffected when the fluid is water since the volume is still the same.

7. A sprinkler comprising:

an inlet connectable to a source of operating fluid, wherein the operating fluid is water for normal operation, or compressed air to blow water out of the sprinkler to prevent freezing during cold weather;

a turbine having a rotor which is driven by the incoming operating fluid and a flow directing stator; and a speed control mechanism located in the fluid flow path which is responsive to behavior exhibited by the operating fluid when that fluid includes compressed air, but is not exhibited by the operating fluid when that fluid does not include compressed air to limit the rotational speed of the turbine when the operating fluid includes compressed air, but which has substantially no limiting effect on rotational speed of the turbine when the operating does not include compressed air, irrespective of the pressure of the operating fluid, within an expected operating pressure range for both water and air; wherein the incoming fluid flows along a surface of the stator; and the speed control mechanism includes a bleed area on the stator which permits compressed air which has expanded as it flows along the stator surface to flow to the sprinkler nozzle without encountering the turbine rotor.

8. A sprinkler comprising:

an inlet connectable to a source of operating fluid, wherein the operating fluid is water for normal operation, or compressed air to blow water out of the sprinkler to prevent freezing during cold weather;

a turbine having a rotor which is driven by the incoming operating fluid and a flow directing stator; and a speed control mechanism located in the fluid flow path which is responsive to behavior exhibited by the operating fluid when that fluid includes compressed air, but is not exhibited by the operating fluid when that fluid does not include compressed air to limit the rotational speed of the turbine when the operating fluid includes compressed air, but which has substantially no limiting effect on rotational speed of the turbine when the operating does not include compressed air, irrespective of the pressure of the operating fluid, within an expected operating pressure range for both water and air, wherein the flow directing stator includes:

a flow directing member that communicates at an upstream end with the fluid inlet, and directs fluid from the upstream end to a downstream end to drive the turbine rotor; and a bleed area intermediate the ends of the flow directing member that permits compressed air which has expanded as it moves downstream to escape into a bypass flow area, and from there, to pass to a discharge area communicating with the sprinkler nozzle without encountering the turbine rotor, thereby limiting the turbine speed when the turbine is driven by compressed air.

9. A sprinkler as defined in claim 8, wherein the fluid is directed from the upstream end to the downstream end of the flow directing member by a plurality of circumferentially spaced longitudinal ribs.

10. A sprinkler as defined in claim 8, wherein the flow directing member includes a plurality of deflector portions at the downstream end thereof to direct fluid to the turbine rotor.

11. A sprinkler comprising:

an inlet connectable to a source of operating fluid, wherein the operating fluid is water for normal operation, or compressed air to blow water out of the sprinkler to prevent freezing during cold weather;

a turbine having a rotor which is driven by the incoming operating fluid and a flow directing stator; and a speed control mechanism located in the fluid flow path which is responsive to behavior exhibited by the operating fluid when that fluid includes compressed air, but is not exhibited by the operating fluid when that fluid does not include compressed air to limit the rotational speed of the turbine when the operating fluid includes compressed air, but which has substantially no limiting effect on rotational speed of the turbine when the operating does not include compressed air, irrespective of the pressure of the operating fluid, within an expected operating pressure range for both water and air; wherein the turbine rotor is located in a rotor chamber which includes a housing having a fluid inlet area and a fluid discharge area; and the flow directing stator includes:

a body portion having a longitudinal axis extending from the fluid inlet toward the rotor chamber;

a plurality of flow paths extending axially along of the body portion; and a plurality of flow deflectors that divert fluid flowing in the axial flow paths to a second path directed toward the fluid inlet area of the rotor chamber.

12. A sprinkler as defined in claim 11, further including an open area along the body portion of the stator which permits compressed air which has expanded as it moves along the axial flow paths to flow through a bypass flow path to the sprinkler nozzle without encountering the turbine rotor, thereby limiting the turbine speed when the turbine is driven by compressed air.

13. A sprinkler as defined in claim 11, further including a by-pass valve located upstream of the flow deflectors, the valve having a central opening within which the stator body is received in radially spaced relationship to define the plurality of axial flow paths in cooperation with a plurality of circumferentially spaced longitudinal ribs on the body portion.

14. A sprinkler as defined in claim 13, wherein the bypass valve is responsive to the pressure of the incoming fluid to divert a portion of the incoming fluid in excess of what is needed to drive the turbine directly to the sprinkler nozzle.

15. A sprinkler comprising:

a fluid inlet connectable to a source of water for normal operation, and to a source of compressed air to blow water out of the sprinkler to prevent freezing during cold weather;

a turbine having a rotor which is driven by the incoming fluid and a flow directing stator; and a speed control mechanism constructed to respond to the behavior of the incoming fluid when that fluid is compressed air to limit the rotational speed of the turbine and to respond to the behavior of a non-compressible fluid when the incoming fluid is water to have substantially no limiting effect on the rotational speed of the turbine, and wherein:

the turbine rotor is located in a rotor chamber which includes a housing having a fluid inlet area and a fluid discharge area;

the flow directing stator includes:

a body portion having a longitudinal axis extending from the fluid inlet toward the rotor chamber;

a plurality of flow paths extending axially along of the body portion; and a plurality of flow deflectors that divert fluid flowing in the axial flow paths to a second path directed toward the fluid inlet area of the rotor chamber;

the axial flow paths are defined by a plurality of circumferentially spaced longitudinal ribs; and the flow deflectors comprise a plurality of deflector surfaces that extend axially, and curve radially outwardly in the downstream direction from downstream ends of the longitudinal ribs.

16. A sprinkler as defined in claim 15, wherein:

the flow deflectors further comprise circumferentially spaced ribs that spiral outwardly from the radially outer ends of the deflector surfaces to direct fluid outwardly and circumferentially to the inlet passage of the rotor chamber.

17. A fluid distribution apparatus operable with compressible and incompressible fluids, the apparatus comprising:

an inlet connectable to a source of incoming fluid for delivery through an outlet device;

a fluid-driven motor having a rotating component driven by the incoming fluid to impart motion to the outlet device, and a non-rotating flow inlet component that directs incoming fluid to drive the rotating component; and a speed control mechanism which is responsive to a property exhibited by compressible fluids, but not exhibited by non-compressible fluids such that, when the incoming fluid includes a compressed component, the speed of the motor is limited, but when the incoming fluid does not include a compressed component, there is substantially no limiting effect on rotational speed of the motor, irrespective of the pressure of the incoming fluid within an expected operating pressure range for both compressible and non compressible fluids, wherein the motor is a turbine and the turbine includes a rotor located in a rotor chamber having a discharge port; and the area of the discharge port is selected such that the flow of the driving fluid through the rotor chamber is limited for compressible fluid, but is substantially unlimited for incompressible fluid; and wherein driving fluid for the rotor enters the rotor chamber through a plurality of inlet ports; and the area of the rotor chamber discharge port exceeds the total area of the inlet ports.

18. An apparatus as defined in claim 17, wherein the speed control mechanism comprises a flow restrictor located in a discharge flow path for the motor.

19. An apparatus as defined in claim 17, wherein the ratio of the area of the rotor chamber discharge port to the total area of the inlet ports is in the range of approximately 1.0 and 2.0.

20. An apparatus defined in claim 17, wherein the area of the rotor chamber discharge port is approximately 1.5 times the total area of the inlet ports.

21. An apparatus as defined in claim 17, further including a bypass valve that is responsive to the pressure of the incoming fluid to divert a portion thereof around the turbine.

22. An apparatus as defined in claim 21, wherein the bypass valve diverts the portion of the incoming fluid through a central opening in the rotating component.

23. An apparatus as defined in claim 17, wherein the compressible fluid is compressed air and the non-compressible fluid is water, and the ratio of the area of the rotor chamber discharge port to the total area of the inlet ports is in the range of approximately 1.0 and 2.0.

24. An apparatus defined in claim 23, wherein the area of the rotor chamber discharge port is approximately 1.5 times the total area of the inlet ports.

25. A fluid distribution apparatus operable with compressible and incompressible fluids, the apparatus comprising:

an inlet connectable to a source of incoming fluid for delivery through an outlet device;

a fluid-driven motor having a rotating component driven by the incoming fluid to impart motion to the outlet device, and a non-rotating flow inlet component that directs incoming fluid to drive the rotating component; and a speed control mechanism which is responsive to a property exhibited by compressible fluids, but not exhibited by non-compressible fluids such that, when the incoming fluid includes a compressed component, the speed of the motor is limited, but when the incoming fluid does not include a compressed component, there is substantially no limiting effect on rotational speed of the motor, irrespective of the pressure of the incoming fluid within an expected operating pressure range for both compressible and non compressible fluids; wherein the rotating component is mounted in a chamber including an inlet; and the property of the compressible fluid to which the speed control mechanism is responsive is the ability to expand in three dimensions in the motor chamber after exiting the non-rotating component, and before contacting the rotating component thereby reducing the mass flow which actually imparts energy to turn the rotating component;

the apparatus further comprising:

a flow directing member that communicates at an upstream end with the fluid inlet, and directs fluid from the upstream end to a downstream end to drive the rotating component of the motor; and a bleed area intermediate the ends of the flow directing member that permits compressed fluid which has expanded as it moves downstream to escape into a bypass flow area, and from there, to pass to a discharge area communicating with the outlet device without encountering the rotating component, thereby limiting the motor speed when the motor is driven by a compressible fluid.

26. An apparatus as defined in claim 25 wherein:

the incoming fluid flows along a surface of the non-rotating component; and the speed control mechanism is comprised of a bleed area on the non-rotating component which permits a portion of the incoming fluid which has expanded as it flows along the surface of the non-rotating component to flow to the outlet device without encountering the rotating component of the motor.

27. An apparatus as defined in claim 25, wherein the fluid is directed from the upstream end to the downstream end of the flow directing member by a plurality of circumferentially spaced longitudinal ribs.

28. An apparatus as defined in claim 25, wherein the flow directing member includes a plurality of deflection portions at the downstream end thereof to direct fluid to the rotating component of the motor.

29. A fluid distribution apparatus operable with compressible and incompressible fluids, the apparatus comprising:

an inlet connectable to a source of incoming fluid for delivery through an outlet device;

a fluid-driven motor having a rotating component driven by the incoming fluid to impart motion to the outlet device, and a non-rotating flow inlet component that directs incoming fluid to drive the rotating component; and a speed control mechanism which is responsive to a property exhibited by compressible fluids, but not exhibited by non-compressible fluids such that, when the incoming fluid includes a compressed component, the speed of the motor is limited, but when the incoming fluid does not include a compressed component, there is substantially no limiting effect on rotational speed of the motor, irrespective of the pressure of the incoming fluid within an expected operating pressure range for both compressible and non compressible fluids, wherein the motor is a turbine and wherein:

the turbine includes a rotor located in a rotor chamber having a fluid inlet area and a fluid discharge area; and the flow inlet component includes:

a body portion having a longitudinal axis extending from the fluid inlet toward the rotor chamber;

a plurality of flow paths extending axially along of the body portion; and a plurality of flow deflectors that divert fluid flowing in the axial flow paths to a second path directed toward the fluid inlet area of the rotor chamber.

30. An apparatus as defined in claim 29, further including an open area along the body portion of the stator which permits compressed fluid which has expanded as it moves along the axial flow paths to flow through a bypass flow path to the outlet device without encountering the turbine rotor, thereby limiting the turbine speed when the turbine is driven by a compressible fluid.

31. An apparatus as defined in claim 29, further including a by-pass valve located upstream of the flow deflectors, the valve having a central opening within which the flow inlet stator body is received in radially spaced relationship to define the plurality of axial flow paths in cooperation with a plurality of circumferentially spaced longitudinal ribs on the body portion.

32. An apparatus as defined in claim 31, wherein the bypass valve is responsive to the pressure of the incoming fluid to divert a portion of the incoming fluid in excess of what is needed to drive the turbine directly to the outlet device.

33. A fluid distribution apparatus operable with compressible and incompressible fluids, the apparatus comprising:

an inlet connectable to a source of incoming fluid for delivery through an outlet device;

a turbine having a rotor driven by the incoming fluid to operate the outlet device, and a flow inlet stator that directs incoming fluid to drive the turbine rotor; and a speed control mechanism constructed to respond to the behavior of the incoming fluid when that fluid is compressible to limit the rotational speed of the turbine, and to respond to the behavior of the incoming fluid when that fluid is non-compressible, to have substantially no limiting effect on the rotational speed of the turbine; and wherein:

the turbine rotor is located in a rotor chamber which includes a housing having a fluid inlet area and a fluid discharge area; and the flow inlet stator includes:

a body portion having a longitudinal axis extending from the fluid inlet toward the rotor chamber;

a plurality of flow paths extending axially along of the body portion; and a plurality of flow deflectors that divert fluid flowing in the axial flow paths to a second path directed toward the fluid inlet area of the rotor chamber;

the axial flow paths are defined by a plurality of circumferentially spaced longitudinal ribs; and the flow deflectors comprise a plurality of deflector surfaces that extend axially, and curve radially outwardly in the downstream direction from downstream ends of the longitudinal ribs.

34. An apparatus as defined in claim 33, wherein:

the flow deflectors further comprise circumferentially spaced swirl ribs that spiral outwardly from the radially outer ends of the deflector surfaces to direct fluid outwardly and circumferentially to the inlet passage of the rotor chamber.

35. A sprinkler as defined in claim 33, wherein the property exhibited by compressed air is the ability to expand to a greater volume and lower density in the turbine, so that the flow restrictor chokes the flow of air, and a back pressure is created on the turbine to limit its speed.

36. A method of winterizing a landscape irrigation sprinkler system including a plurality of turbine-driven sprinklers, the method comprising the steps of:

pressurizing at least one supply line connected to the plurality of sprinklers with a compressible fluid to remove water therefrom to thereby avoid breakages that would otherwise result from freezing and expansion of the water in the winter; and preventing over-spinning of the turbine by providing a speed limiting mechanism that is responsive to a property exhibited by compressible fluids and not exhibited by non-compressible fluids such that, when the incoming fluid includes the compressible fluid, the rotational speed of the turbine is limited, but when the turbine is water-driven, there is substantially no limiting effect on the rotational speed of the turbine irrespective of the pressure of the incoming fluid within an expected fluid pressure range for water and for the compressible fluid, whereby damage to the turbine and/or related drive components of the sprinklers is avoided, wherein the step of preventing over-spinning is accomplished by re-directing pressurized compressible fluid around the turbine in response to behavior exhibited by a compressible fluid, but not exhibited by a non-compressible fluid, and wherein each of the sprinklers includes a flow directing member that communicates at an upstream end with the supply line and directs fluid from the upstream end to a downstream end to drive the turbine rotor; and pressurized compressible fluid is redirected by a bleed area intermediate the ends of the flow directing member that permits compressed fluid which has expanded as it moves downstream to escape into a bypass flow area, and from there, to pass to a discharge area communicating with the sprinkler nozzle without encountering the turbine rotor, thereby limiting the turbine speed when the turbine is driven by compressed fluid.

37. The method of claim 36, wherein the redirecting is performed by a valve.

38. The method of claim 37, wherein the valve redirects the portion of the incoming compressed air through a central opening in the turbine stator.

39. The method of claim 36, wherein the pressurized compressible fluid is air.

40. A sprinkler comprising:

an inlet connectable to a source of operating fluid, wherein the operating fluid is water for normal operation, or compressed air to blow water out of the sprinkler to prevent freezing during cold weather;

a turbine having a flow directing stator, and a rotor which is mounted in a rotor chamber, and which is driven by the incoming operating fluid; and a speed control mechanism located in the fluid flow path which is responsive to behavior exhibited by the operating fluid when that fluid includes compressed air, but is not exhibited by the operating fluid when that fluid does not include compressed air such that the rotational speed of the turbine is limited when the operating fluid includes compressed air, but is not substantially limited when the operating fluid is water, wherein:

the speed control mechanism includes a mechanism for establishing a desired pressure differential across an inlet of the rotor chamber, and a restricted orifice forming an outlet for the rotor chamber; and the areas of the rotor chamber inlet and outlet are selected so that the established pressure differential through the rotor chamber allows the flow of operating fluid through the chamber to be restricted when the operating fluid includes compressed air but to be substantially unrestricted when the operating fluid does not include compressed air, whereby the rotational speed of the turbine is reduced when the operating fluid includes compressed air, but not when the operating fluid is water; and wherein the pressure differential is established by a spring-biased valve.

41. A sprinkler as defined in claim 40, wherein the ratio of the total areas of the rotor chamber discharge and inlet ports is in the range of approximately 1.0 and 2.0.

42. A sprinkler as defined in claim 40, wherein the ratio is approximately 1.5 times the total area of the inlet ports.

43. A sprinkler as defined in claim 40, wherein the flow is restricted when the operating fluid includes compressed air due to the ability of a compressible fluid to expand in three dimensions to lower density through the established pressure differential, thereby filling the space and causing a back pressure which chokes the fluid flow, and which expansion does not occur when the operating fluid does not include a compressible fluid.

* * * * *